US006018218A

United States Patent [19]

Terada et al.

[11] Patent Number: 6,018,218

[45] Date of Patent: Jan. 25, 2000

[54] FLUORESCENT LAMP WITH INTERNAL GLASS TUBE

[75] Inventors: Toshiyuki Terada, Tokyo; Kazuaki Kawasaki, Kanagawa-ken, both of Japan

[73] Assignee: Sanyo Electric Co., Ltd., Tokyo, Japan

[21] Appl. No.: 08/934,096

[22] Filed: Sep. 19, 1997

[30] Foreign Application Priority Data

Jul. 4, 1997 [JP] Japan ..... 9-179733

[51] Int. Cl.[7] ..... H01J 61/04

[52] U.S. Cl. ..... 313/488; 313/491; 313/234; 313/607

[58] Field of Search ..... 313/491, 488, 313/485, 594, 234, 607, 113, 114

[56] References Cited

U.S. PATENT DOCUMENTS

| | | | |
|---|---|---|---|
| 2,457,503 | 12/1948 | Singer | 313/485 |
| 4,983,881 | 1/1991 | Eliasson et al. | 313/607 |
| 5,013,959 | 5/1991 | Kogelschatz | 313/607 |
| 5,173,638 | 12/1992 | Eliasson et al. | 313/607 |
| 5,444,331 | 8/1995 | Matsuno et al. | 313/607 |
| 5,648,700 | 7/1997 | Chu et al. | 313/491 |

FOREIGN PATENT DOCUMENTS

| | | | |
|---|---|---|---|
| 7272692 | 10/1995 | Japan | H01J 65/04 |
| 7272694 | 10/1995 | Japan | H01J 65/04 |
| 9283091 | 10/1997 | Japan | H01J 65/00 |

*Primary Examiner*—Michael H. Day
*Attorney, Agent, or Firm*—Weingarten, Schurgin, Gagnebin & Hayes LLP

[57] ABSTRACT

A fluorescent lamp (1) includes a tubular glass bulb (2), an internal electrode (5) within the tubular glass bulb (2), a fluorescent layer (4) formed on an inner surface of the glass bulb (2), an external electrode (3) provided on an outer surface of the glass bulb (2), and a covering glass tube (6) is disposed over the total length of the internal electrode (5). The fluorescent lamp (1) further includes a fluorescent layer (7) disposed on the outer surface of the glass tube (6). The fluorescent lamp (1), as configured above, makes it unnecessary to form the internal electrode into a coil, and absorbs the difference in thermal expansion coefficients. This prevents the internal electrode (5) from resonating with vibrations from the outside and prevents contact of the fluorescent layer (4) by the internal electrode (5).

4 Claims, 2 Drawing Sheets

FLUORESCENT LAMP WITH INTERNAL GLASS TUBE

BACKGROUND OF THE INVENTION

1. Field of the Invention

This invention relates to a fluorescent lamp comprising a pair of electrodes and, more specifically, to a fluorescent lamp in which one of the electrodes is provided outside a discharge chamber as an external electrode and the other electrode is provided inside the discharge chamber as an internal electrode so as to cause discharge through a tubular glass bulb which is a dielectric.

2. Background Art

FIG. 4 shows an example of this type of fluorescent lamp 90 of the prior art which comprises a tubular glass bulb 91 having a fluorescent layer 92 formed on the inner surface and a pair of electrodes. The tubular glass bulb is sealed at both ends, air is exhausted from and a gas is charged into the tubular glass bulb 91 to form a discharge chamber 91*a*. One of the electrode is an external electrode 93 provided on the outer surface of the tubular glass bulb 91.

The other of the electrodes is an internal electrode 94 formed of a metal wire and provided substantially at the center in an axial direction of the tubular glass bulb 91 in the discharge chamber 91*a*. To prevent excessive tensile stress or sag generated by the difference of thermal expansion coefficient between the tubular glass bulb 91 and the metal wire (i.e., the internal electrode 94), the metal wire is formed into a coil and is given appropriate tension when it is installed.

In the fluorescent lamp 90 of the prior art described above, since a coil is used as the internal electrode 94, the problem caused by the difference of thermal expansion coefficient is solved. However, the internal electrode 94 resonates with vibration, freely vibrates and contacts the fluorescent layer 92 formed on the inner surface of the tubular glass bulb 91, thereby scratching or removing the fluorescent layer 92 from the glass bulb 91.

This problem cannot be ignored because the fluorescent lamp 90 may be used as a back light source for a liquid crystal display which is used for a car TV receiver or a car navigation system in many cases and is easily vibrated by the running of a vehicle.

SUMMARY OF THE INVENTION

An object of the present invention for solving the above problem of the prior art is to provide a fluorescent lamp comprising a tubular glass bulb, an internal electrode provided inside the tubular glass bulb, a fluorescent layer formed on an inner surface of the tubular glass bulb, and an external electrode provided on an outer surface of the tubular glass bulb, wherein the fluorescent lamp further comprises a pipe-shaped covering glass tube which has a length over the total length of the internal electrode and sheathe the internal electrode.

Another object of the present invention is to provide a fluorescent lamp as above, in which at least one end portion of the covering glass tube is welded to the tubular glass bulb.

Still another object of the present invention is to provide a fluorescent lamp as above, in which said fluorescent lamp further comprises a covering tube fluorescent layer formed on an outer surface of the covering glass tube.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

Figure 1:
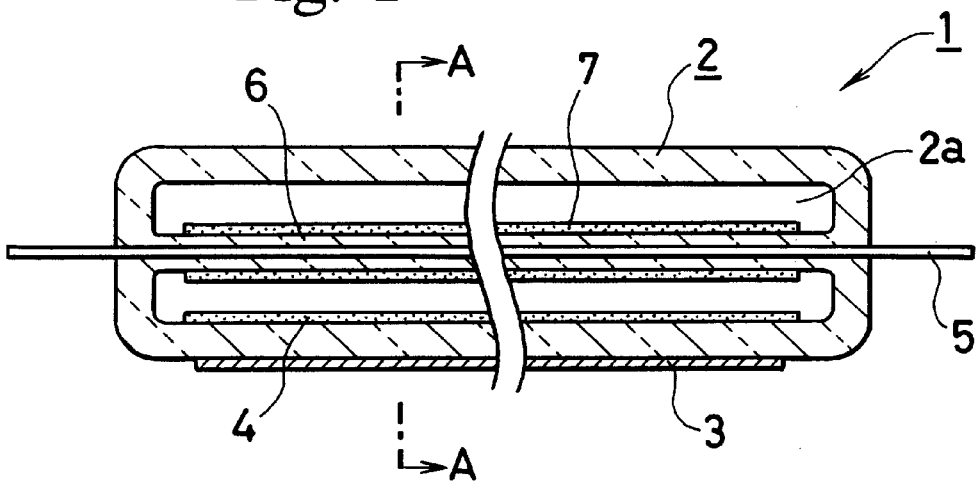
FIG. 1 is a sectional view of a fluorescent lamp according to an embodiment of the present invention.
Figure 2:
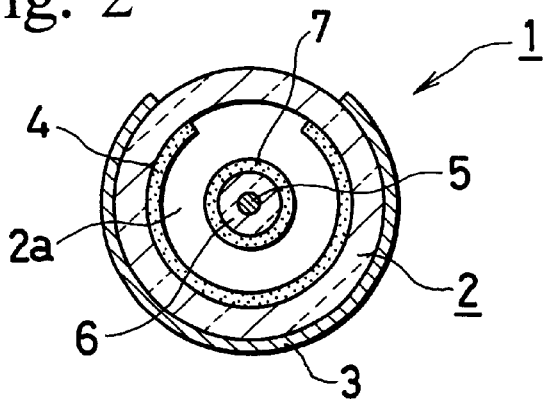
FIG. 2 is a sectional view taken on line A—A of FIG. 1.

The present invention is described in detail hereinafter with reference to embodiments shown in the accompanying drawings. In FIGS. 1 and 2, numeral 1 designates a fluorescent lamp according to the present invention. The fluorescent lamp 1 comprises a tubular glass bulb 2, an external electrode 3 provided on the outer surface of the tubular glass bulb 2, a fluorescent layer 4 formed on the inner surface of the tubular glass bulb 2, and an internal electrode 5 provided substantially at the center in an axial direction of the tubular glass bulb 2 like the prior art.

In the present invention, the internal electrode 5 is sheathed with a covering glass tube 6 which is shaped like a pipe having an inner diameter almost equal to the outer diameter of the internal electrode 5. In this embodiment, the covering glass tube 6 is welded to the tubular glass bulb 2 at both ends. In addition, in this embodiment, a covering tube fluorescent layer 7 is formed on the outer surface of the covering glass tube 6 like the inner surface of the tubular glass bulb 2.

To sheath the internal electrode 5 with the covering glass tube 6, the internal electrode 5 may be inserted into the covering glass tube 6 shaped as a pipe, or a low-melting glass paste is coated on the outer surface of the internal electrode 5 and baked to form the covering glass tube 6.

When the covering glass tube 6 is welded to the tubular glass bulb 2 as in this embodiment, there is a possibility that a connection portion may be cracked by the difference of properties between materials forming these elements after use. In this case, the tubular glass bulb 2 and the covering glass tube 6 are preferably made from the same material or materials having similar properties.

A description is subsequently given of the function and effect of the fluorescent lamp 1 of the present invention configured as described above. Generally, when the internal electrode 5 is sheathed with the covering glass tube 6 as described above and integrated with the covering glass tube 6 by appropriate means as baking, for example, thermal expansion of the internal electrode having a larger thermal expansion coefficient made from a metal is reduced by covering glass tube 6 having a small thermal expansion coefficient made from glass.

Therefore, when ambient temperature varies, the internal electrode 5 sheathed with the covering glass tube 6 changes the size thereof at a reduced thermal expansion degree close to that of the tubular glass bulb 2. Therefore, the internal electrode 5 can be installed without being formed into a coil to absorb the difference of thermal expansion coefficient between the electrode and the tubular glass bulb 2.

Since the above formation of the internal electrode 5 into a coil is unnecessary, the internal electrode 5 itself rarely resonates with vibration applied from the outside. Further, since its rigidity has been improved by sheathing with the covering glass tube 6, the internal electrode 5 resonates more rarely, thereby making it possible to prevent the internal electrode 5 from contacting the fluorescent layer 4 completely.

In this embodiment, since the covering glass tube 6 is connected to the tubular glass bulb 2 at both ends, a sealed space, that is, a discharge chamber 2*a* is formed by the outer surface of the covering glass tube 6 and the inner surface of the tubular glass bulb 2, and there is no problem if the inner surface of the covering glass tube is exposed to the air.

When the fluorescent lamp is formed as described above, the internal electrode 5 only needs to be inserted into the covering glass tube 6 for assembly. If the internal electrode 5 thermally expands in this state, it can freely slide in the covering glass tube 6. Therefore, only in this embodiment, thermal expansion of the internal electrode 5 having the larger thermal expansion coefficient does not need to be reduced by integrating the internal electrode 5 with the covering glass tube 6 by welding and only the free vibration (inclination, deflection) of the internal electrode 5 has to be prevented.

Figure 3:
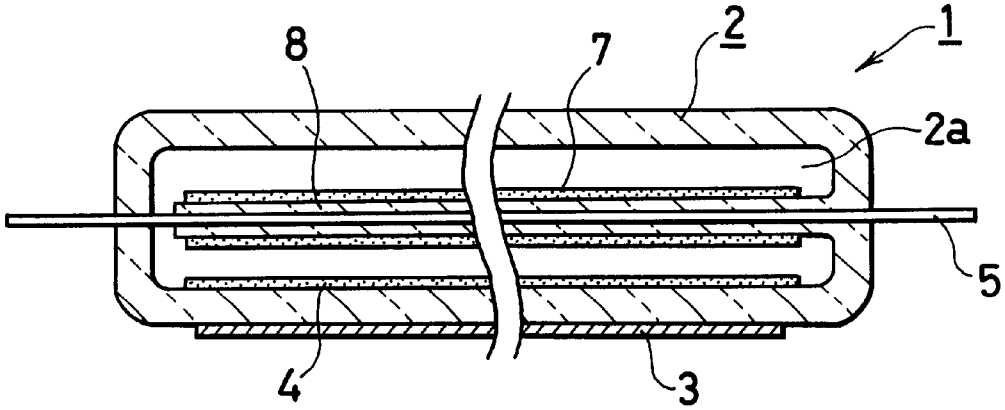
FIG. 3 is a sectional view of a fluorescent lamp according to another embodiment of the present invention.
Figure 4:
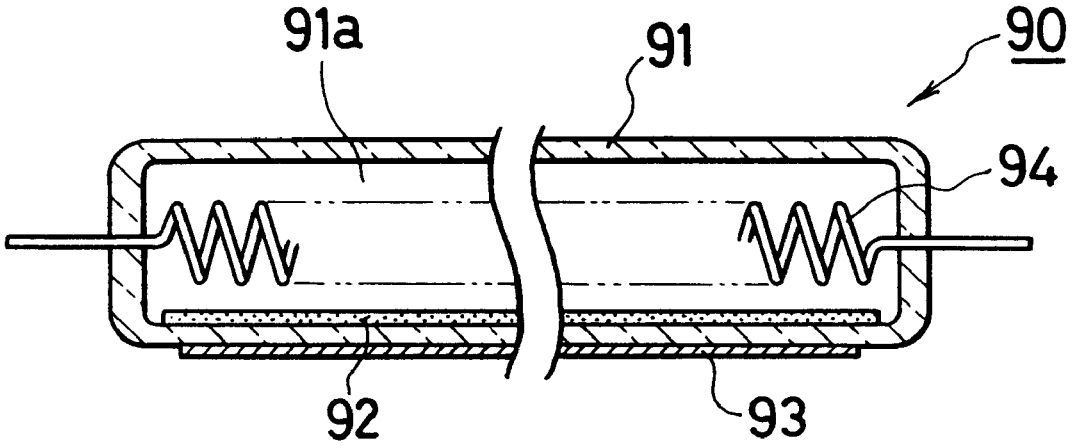
Fig. 4 Prior Art
FIG. 4 is a sectional view of a fluorescent lamp according to the prior art.

In this embodiment, since a covering tube fluorescent layer 7 is formed on the outer surface of the covering glass tube 6, a light emission source can be obtained substantially at the center in an axial direction of the tubular glass bulb 2, and the fluorescent lamp 1 is further approximated to a theoretically linear light source, thereby making it possible to improve the setting accuracy of light distribution characteristics of lighting equipment using this fluorescent lamp 1, FIG. 3 shows another embodiment of the present invention. While the covering glass tube is connected to the tubular glass bulb 2 at both ends in the previous embodiment, the present invention is not limited to this. As shown in the figure, the covering glass tube 8 may be connected to the tubular glass bulb 2 at only one end, or both end portions of the covering glass tube 8 may not be connected to the tubular glass bulb 2.

In short, the object of the present invention is that the internal electrode 5 can be installed without forming it into a coil by reducing thermal expansion of the internal electrode 5 having the larger thermal expansion coefficient by integrating it with the covering glass tube 8. The internal electrode 5 only needs to be installed with most part thereof in a lengthwise direction integrated with the covering glass tube 8. Also in this embodiment, it is needless to say that it is optional to form the covering tube fluorescent layer 7 on the outer surface of the covering glass tube 8.

As described above, since the fluorescent lamp is configured such that the internal electrode is sheathed with a substantially pipe-shaped covering glass tube over substantially the total length thereof, thermal expansion of the internal electrode having the larger thermal expansion coefficient is reduced by sheathing the internal electrode with the covering glass tube, thereby making it unnecessary to form the internal electrode into a coil as in the prior art to absorb the difference of thermal expansion coefficient.

Therefore, the problem caused by the above formation that the internal electrode resonates with vibration from the outside and scratches the fluorescent layer is solved. This type of fluorescent lamp can be used as a light source for a device which is always subjected to vibration, such as a light source for vehicle equipment, for example. Thus, the present invention has such extremely excellent effects that reliability is improved and application is expanded.

Since the covering glass tube is provided, a fluorescent layer can be formed on the outer surface of the covering glass tube and light can be emitted at a location near the center in an axial direction, thereby making it possible to approximate the fluorescent lamp to a theoretical linear light source. Therefore, the present invention has such an effect that the formation accuracy of light distribution characteristics is improved.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A fluorescent lamp comprising a tubular glass bulb, an internal electrode provided inside the tubular glass bulb, a fluorescent layer formed on at least a portion of an inner surface of the tubular glass bulb, an external electrode provided on at least a portion of an outer surface of the tubular glass bulb, and a light emitting portion defined by a portion of said tubular glass bulb which is not covered by said fluorescent layer and which is also not covered by said external electrode, wherein the fluorescent lamp further comprises a pipe-shaped covering glass tube which has a length over the total length of the internal electrode and which sheathes the internal electrode.

2. The fluorescent lamp according to claim 1, wherein at least one end portion of the covering glass tube is welded to the tubular glass bulb.

3. The fluorescent lamp according to claim 2, wherein said fluorescent lamp further comprises a covering tube fluorescent layer formed on at least a portion of an outer surface of the covering glass tube.

4. The fluorescent lamp according to claim 1, wherein said fluorescent lamp further comprises a covering tube fluorescent layer formed on at least a portion of an outer surface of the covering glass tube.

* * * * *

UNITED STATES PATENT AND TRADEMARK OFFICE

CERTIFICATE OF CORRECTION

PATENT NO. : 6,018,218
DATED : January 25, 2000
INVENTOR(S) : Toshiyuki Terada et al.

It is certified that error appears in the above-identified patent and that said Letters Patent is hereby corrected as shown below:

Title page,
Item [73], Assignee, "Sanyo Electric Co., Ltd.," should read -- Stanley Electric Co., Ltd., --.

Signed and Sealed this

Fourteenth Day of October, 2003

JAMES E. ROGAN
*Director of the United States Patent and Trademark Office*